US006511147B2

(12) United States Patent
Kubota et al.

(10) Patent No.: US 6,511,147 B2
(45) **Date of Patent: *Jan. 28, 2003**

(54) INK-JET PRINTER HAVING HEATING CONTROL FOR PRINT MEDIUM

(75) Inventors: Hidemi Kubota, Inagi (JP); Isao Kimura, Kawasaki (JP); Hiroyuki Maeda, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/982,452

(22) Filed: Dec. 2, 1997

(65) Prior Publication Data

US 2001/0030679 A1 Oct. 18, 2001

(30) Foreign Application Priority Data

Dec. 3, 1996 (JP) ..... 8-323073

(51) Int. Cl.[7] ..... B41J 2/01
(52) U.S. Cl. ..... 347/16; 347/102
(58) Field of Search ..... 347/17, 16, 102; 399/334, 320; 101/424.1, 488; 219/216

(56) References Cited

U.S. PATENT DOCUMENTS 5,212,498 A * 5/1993 Sugimori ..... 346/25
5,371,531 A * 12/1994 Rezanka et al. ..... 347/43
5,502,475 A * 3/1996 Kaburagi et al. ..... 347/102
5,784,090 A * 7/1998 Selensky et al. ..... 347/102

FOREIGN PATENT DOCUMENTS

| | | |
|---|---|---|
| JP | 56-82290 | 7/1981 |
| JP | 62-135368 | 6/1987 |
| JP | 62-173259 | 7/1987 |
| JP | 63-317351 | * 12/1988 |
| JP | 2-235748 | 9/1990 |
| JP | 03-021456 | * 1/1991 |
| JP | 5-50706 | 3/1993 |
| JP | 06-239013 | * 8/1994 |
| JP | 6-297698 | 10/1994 |
| JP | 7-314661 | 12/1995 |
| JP | 8-207262 | 8/1996 |
| JP | 8-333534 | 12/1996 |

* cited by examiner

*Primary Examiner*—Robert Beatty
(74) *Attorney, Agent, or Firm*—Fitzpatrick, Cella, Harper & Scinto

(57) ABSTRACT

Ink permeation with respect to paper differs in accordance with the temperature of the paper. As the temperature increases, the permeation increases, thus the ink immediately permeates into the paper as soon as it is attached to the paper. Accordingly, in a color ink-jet printer, upon printing, a portion in a print line of the paper is heated in accordance with control information corresponding to area designation information which is separate from print information. As ink quickly permeates at the heated portion, after printing with ink of a color, subsequent ink of another color does not mix with the previous color ink, thus bleeding can be prevented. Further, an area of character or the like is not heated, so that ink does not quickly permeate, thus feathering of outlines can be prevented.

60 Claims, 17 Drawing Sheets

INK-JET PRINTER HAVING HEATING CONTROL FOR PRINT MEDIUM

BACKGROUND OF THE INVENTION

This invention relates to an ink-jet printer and printing method therefor which perform printing by discharging ink as ink droplets from a discharge orifice such that the ink droplets are attached to the surface of a print medium and, more particularly, to an ink-jet printer and printing method therefor which prevent feathering and bleeding, realize good color development, and form a high quality image in accordance with the image type.

DESCRIPTION OF RELATED ART

Conventionally, as ink for ink-jet printing, water ink mainly is used for the purposes of safety, prevention of bad smell and the like. A known example of the water ink is obtained by dissolving or dispersing various water dyes or pigments in water, or in water and a water-soluble organic solvent, and adding a wetting agent, dye dissolution accelerating agent, antifungal agent and the like to the solvent, in accordance with necessity. The ink-jet printing method has many advantages as follows: high-speed printing can be performed by discharging such ink as several thousands of ink droplets per second; printing can be performed with reduced noise; color printing can be easily performed; printing can be performed in high resolution; and normal paper can be used in printing. Accordingly, the ink-jet printing method has become very popular in recent years.

Further, with the lowered prices and high performance of personal computers and the standardization of the GUI (Graphical User Interface) environment, there are increasing needs for good color development, high quality, good durability, high resolution and high speed in image printing by printers. For this reason, technical ideas to keep color matter on the surface of paper as much as possible, to form sharp edges of print dots, and to reduce ink spread, that is, feathering, bleeding or the like, have been proposed, and related products have been sold. These techniques are briefly classified into a printing technique which uses a print sheet called normal paper as a print medium, and a printing technique which uses paper for ink-jet printing. The normal paper, which is used in a copier and the like, is produced with low cost, and has practically excellent characteristics. Further, in recent years, paper for copiers which controls ink spread and has a certain degree of adaptability to ink-jet printing has been introduced.

To print a really high-quality image, it is necessary to use a special paper for ink-jet printing. The special paper is obtained by coating the surface layer of the paper with various materials. By using this paper, ink absorption, color development and the like are controlled, and high-quality images and characters are represented. This is a very excellent method to provide high-quality images; however, it has various practical drawbacks as follows: the cost of the special paper is high; notes cannot be easily written by a pencil or pen on the coated special paper surface; the special paper provides an unpleasant touch; the special paper cannot be used in a copier; and the weight of the paper is heavier than normal paper.

Generally, normal paper is mainly used in view of the above drawbacks of the special paper, however, it is necessary to use specialized ink for the normal paper. Ink which quickly permeates into paper is inappropriate to print sharp character images. However, if the permeation is prevented too much, the ink remains on the paper surface in a liquid state, which might dirty a finger or the like touching the ink after printing and which causes a blur by contact with the finger or the like. Accordingly, ink for printing by using normal paper is prepared in consideration of the balance between the permeability and non-permeability such that sharp characters can be printed. When printing only characters, usually black characters are printed on a white base of the paper. In this case, the ink for black characters is prepared as above.

On the other hand, color printers have been widely used in recent years. In the case of color printing, the situation is greatly different. For example, in the case of printing characters on a uniform color base, if ink in which permeability with respect to the paper is suppressed to a certain degree as above is used, the color ink mixes with another color ink at a portion where the different colors are in contact, which causes so-called feathering or bleeding. The feathering and bleeding greatly degrade image quality. Accordingly, the trend of ink in recent years in color ink-jet printing is ink which contains a surface active agent and which permeates into the paper very quickly. In the use of this ink, if printing is performed by using a first color ink and then printing is performed by using a second color ink, the first color ink used in the first printing has already permeated into the paper at the next printing. This prevents feathering and bleeding, and prints a high-quality image on normal paper. However, in a case where black characters or color characters are printed on normal paper, the edges of the characters are not sharp because the ink permeates into the paper and at the same time the ink spreads along the paper surface. Further, as the ink permeates into the inside of the paper, printing density is lowered to a certain degree due to light scattered by the fibers of the paper surface. The scattered light produces a color image in a low-saturation. For this reason, an image printed by so-called ink-jet printing on normal paper is poor in comparison with an image printed on paper for ink-jet printing.

Then, to obtain an image with high-quality upon ink-jet printing on normal paper, a technique to heat the print medium from the rear surface side of the medium, before printing, during the printing, and after the printing has been proposed.

This technique is disclosed in, e.g., Japanese Patent Application Laid-Open No. 56-82290. Further, Japanese Patent Application Laid-Open Nos. 62-135368 and 62-173259 propose providing a plurality of heaters. However, these techniques aim to finally realize a unique temperature in the entire area of a print medium regarding a head scanning direction, although they perform heating corresponding to the type of print medium or pre-heating the print medium in a sheet conveyance direction. Further, Japanese Patent Application Laid-Open No. 63-317351 proposes moving a heating area in correspondence with movement of a printhead, thus saving heating energy. However, the heating area is moved in synchronization with the movement of the printhead and in dependence on the position information of the printhead. That is, none of these techniques aims to control permeation of the ink with respect to the print medium in accordance with image characteristics.

Accordingly, regarding feathering or bleeding, the above technique still has an unremovable problem. To obtain sharp character images in general documents, it is desirable that feathering or bleeding is prevented as much as possible. Characters can be clear if character portions and base portions, e.g., black portions and white base portions, are separated as clearly as possible. In so-called business color documents as well as black characters, the feathering or bleeding should be prevented as much as possible. In the business color documents, data in graphical representation such as a circle graph and a bar graph are formed by using various colors to visually assist people's understanding of the documents. Further, in these documents, the base color is not always white but may be totally or partially another color. In these color documents, actual colors usually have a constant color hue and density in a specific region. Further, the number of colors is not so large. As mentioned above, if printed portions and base portions are clearly separated and feathering or bleeding is prevented as much as possible, high-quality color documents can be obtained, similar to character printing.

However, if a so-called natural image is printed by using this method, the following problem occurs. In a natural image, various colors are used. More specifically, at a very thin color portion, ink is often scattered in a wide area. To scatter ink in a wide area, various methods are employed. For example, if an area has constant color hue and intensity, dots are diffused in a regular pattern. Otherwise, an error diffusion method to diffuse dots by using prior and subsequent data can be used. However, in any method, a portion where high-density ink dots are scattered without spread is conspicuous to a human eye. In the above-mentioned business color documents, visual color data portions usually have uniform print patterns; therefore, the ink-scattered portions do not attract attention. However, in natural images, such portions are very unnatural, resulting in images which have excellent color representation but which have a rough-touch and poor quality.

To solve these problems, various methods are used; for example, ink which permeates into a print medium without causing spread, or a special print medium, is used. However, these methods are applied to the entire document sheet. That is, it is very difficult to print a document including a character portion which requires sharp edges, a color portion which requires vivid colors without color mixture, and a natural image portion which should avoid rough touch, on so-called normal paper, with high quality.

SUMMARY OF THE INVENTION

The present invention has been made to solve the above problems, and its object is to provide an ink-jet printer which print-outputs an image containing different types of images such as a natural image and a character image with high quality, and a printing method for the printer.

According to the present invention, the ink-jet printer to attain the foregoing object comprises: heating means for heating a desired area of a print medium; printing means for printing an image by discharging ink droplets onto the print medium; and control means for controlling said heating means and said printing means to heat an area of the print medium in accordance with control information while printing an image based on image information by discharging ink droplets onto the heated area.

Further, the printing method to attain the foregoing object comprises: a heat control step of heating an area, designated by control information, on a print medium; and a print control step of printing an image on the area heated at said heat control step.

By the above constructions, printing effects intended by a user can be attained by ink permeation control by totally or partially heating the surface of the paper.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 1:
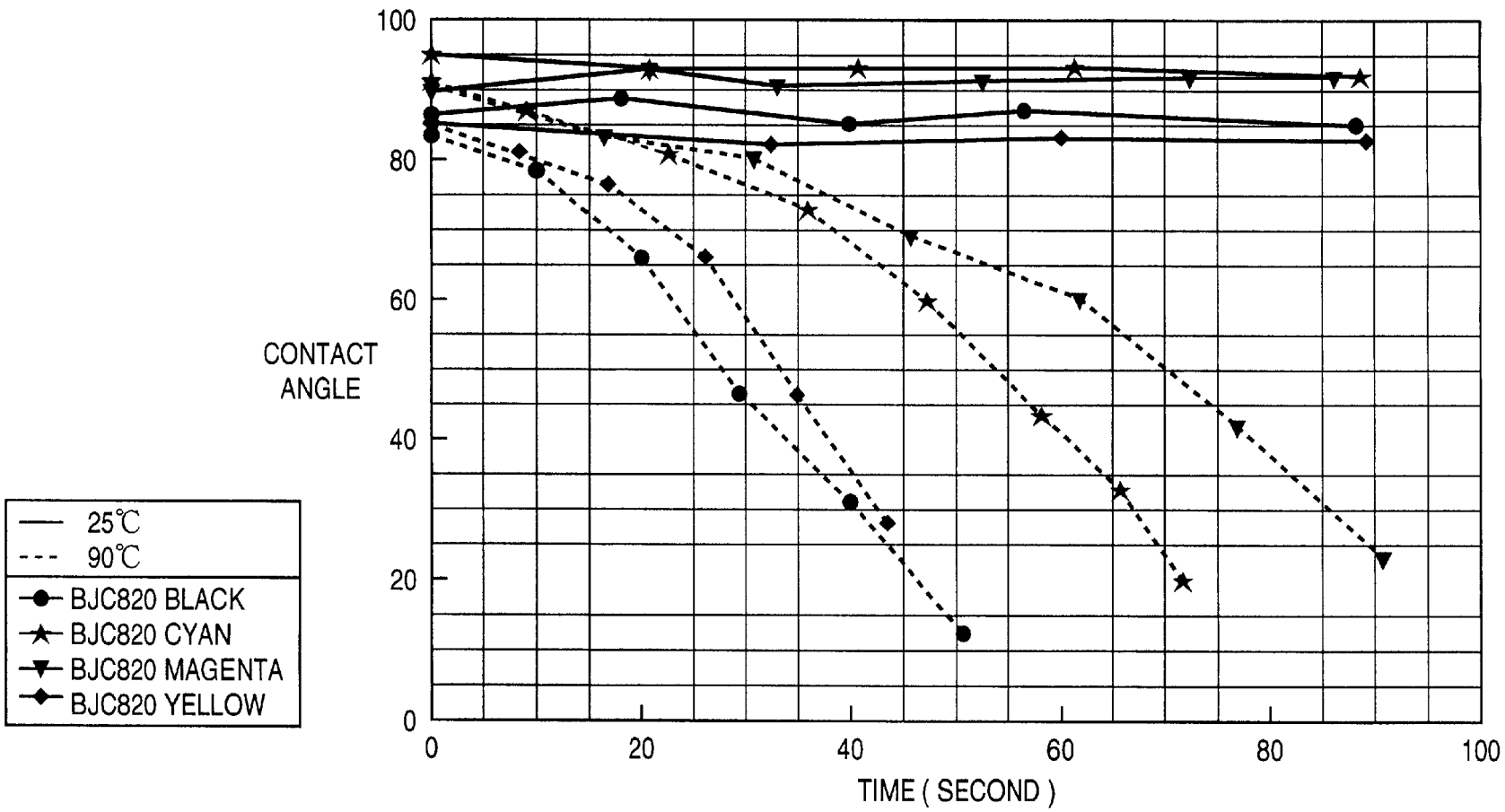
FIGS. 1 to 3 are line graphs showing changes of contact angle of ink for an ink-jet printer in accordance with temperature and time.

Preferred embodiments of the present invention will now be described in detail in accordance with the accompanying drawings.

[First Embodiment]

As an embodiment of the present invention, an ink-jet printer which print-outputs an image by heating ink to cause film boiling and discharging ink droplets in accordance with image information to form dots on a print medium will be described. First, prior to the description of the construction of the printer, the composition and temperature characteristics of ink used in the printer will be described. Note that ink spread means feathering, bleeding or the like in the specification as mentioned above.

<Temperature Characteristics of Ink>

Generally, when liquid is placed on so-called normal paper, the liquid makes two types of movements. One movement is to spread in a horizontal direction along the paper surface, and the other movement is permeate in a thickness direction into the inside of the paper. Note that these movements are not independent of each other but are related to each other; therefore, in consideration of the differences among paper types, manufacturers and the like, it is difficult to uniformly define these movements.

First, the characteristic two types of ink used in the ink-jet printing method will be described. The first ink is used only for character printing. In a case where only characters are printed on so-called normal paper, a required characteristic of the first ink is that permeability with respect to the paper surface is suppressed to a certain degree. If the speed of permeation of the ink with respect to the paper is high, the ink quickly spreads on the paper surface. In this case, the diameter of a dot printed on the paper becomes large, which degrades the resolution. At this time, the ink also permeates into the inside of the paper, i.e., most of the ink moves from the paper surface to the inside of the paper, thus the printing density is lowered. From these two reasons, it is understood that ink with high permeation speed cannot be used because it degrades printing quality of characters. Accordingly, the first ink has a comparatively high surface tension so as to suppress permeation with respect to the paper such that wettability of the fiber of the paper with respect to the ink is suppressed to a lower level.

The second ink is not used for printing characters but for printing images. The feature of an image is that a picture appears on the entire paper surface, different from the case of characters. That is, ink must be uniformly attached to a predetermined area. In a case where the above-described first ink is employed in image printing, a problem occurs if areas of two different colors, for example, are in contact on a border line. Since the permeation of the first ink with respect to the paper is suppressed to a certain degree, after the first color ink is applied to the paper surface, the second color ink is applied before the first color ink permeates into the paper. On the border line between the two colors, the first color ink and the second color ink are in contact with each other before these liquids permeate into the paper. At this time, the first color ink and the second color ink mix with each other, and the initially intended border line is disturbed. Further, on the border line, if the first color ink has started to permeate into the inside of the paper, the second color ink that has been applied to the paper surface in the next printing flows toward the first color ink. Accordingly, a bleeding pattern is formed and the shape of the border is unintentionally disturbed, thus the image quality is remarkably degraded.

Generally, to form an image while preventing the above color mixture, a small amount of a surface active agent is added to the ink so as to increase permeation speed with respect to the paper. This is the second ink. However, if the second ink is used for printing characters, the printing quality is degraded and printed characters become illegible. When the second ink droplets are attached to the paper, the ink quickly permeates into the fiber of the paper by the surface active agent and it quickly spreads along the paper surface as well as the inside of the paper. Therefore, the diameter of the print dots becomes very large, and the density of the print dots is degraded. Characters printed by using this ink have a low density and have non-sharp edges; therefore the quality of the entire document is degraded in comparison with that obtained by other printing methods such as laser-beam printing.

Accordingly, to attain both image quality and character quality, it can be considered to use the first ink for printing characters and the second ink for printing images. Especially, black ink is usually used for printing characters; therefore, it may be arranged such that the first ink is used for printing black color, and the second ink is used for printing the other colors, i.e., cyan, magenta and yellow colors. However, in this method, a problem occurs when black characters are printed on an uniform color base. That is, the black ink spreads on the color base, thus causing feathering. To solve this problem, generally, a small amount of a surface active agent is added to the black ink so as to increase permeability with respect to the paper. However, in this method, as the first ink for black characters has increased permeation with respect to the paper, the above-described characteristic of the first ink is lost.

Figure 2:
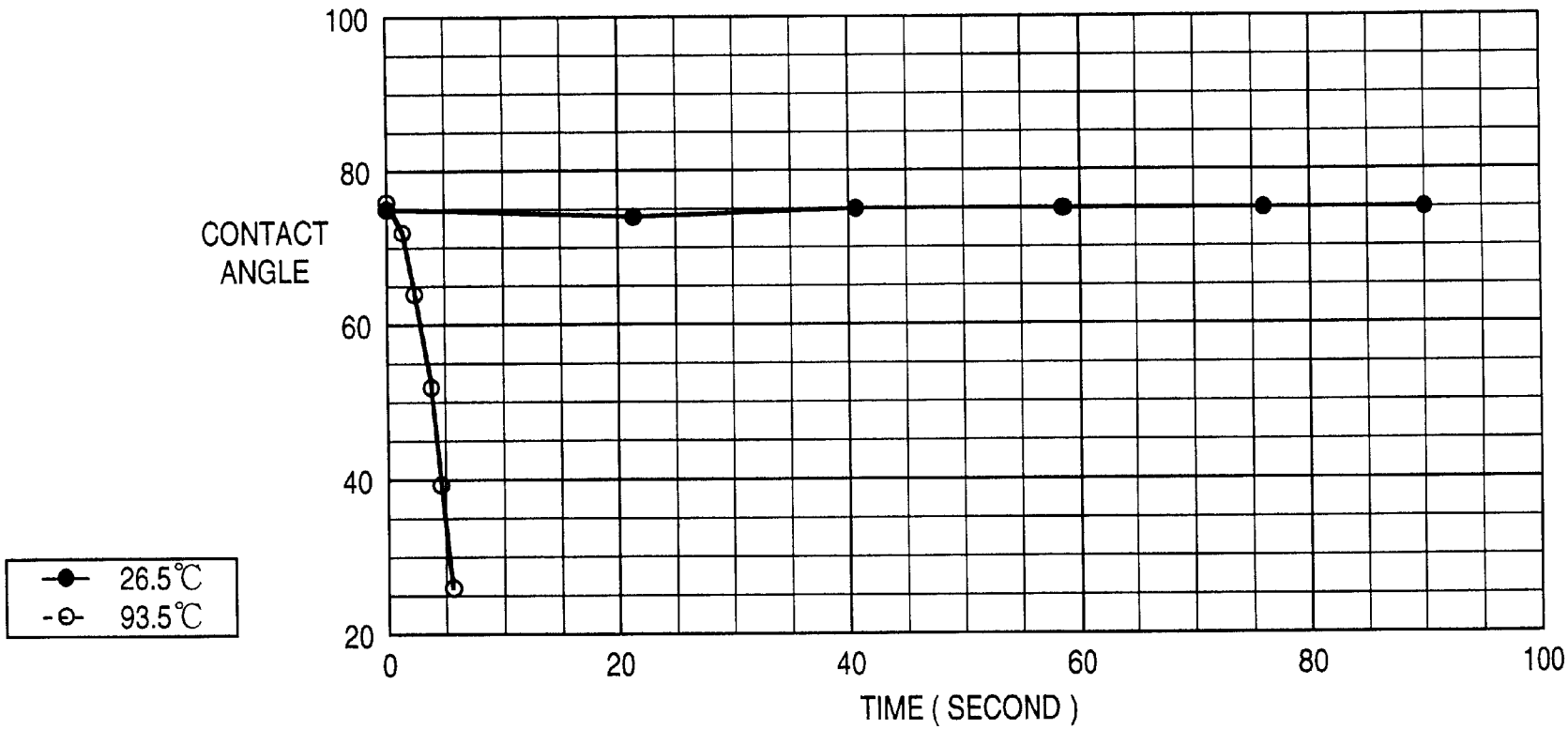

On the other hand, according to the observation by the present inventor, the speed of permeation of liquid dropped on normal paper increases as the temperature rises. FIG. 1 shows the result of measurement of the contact angle of color ink for an ink-jet printer BJ820J by Canon Kabushiki Kaisha at paper temperatures of 25° C. and 90° C. Note that the contact angle here is somewhat different from a contact angle (strictly defined as advance contact angle and reversing contact angle) which is formed at a surface between a solid phase and a gas phase when a liquid is dropped onto the mirror-shaped surface of a solid object of a uniform material. The contact angle in FIG. 1 is an angle of contact among a gas phase, a liquid phase and a solid phase, measured from a side position by contact angle meters CA-D by Kyowa Interface Science Co., Ltd. in a dynamic state where an ink droplet permeates into the inside of the paper while it spreads on the paper surface. As it is understood from the graph, at a high temperature, the time change of the contact angle is large, and the ink quickly permeates into the inside of the paper. More specifically, it is considered that the time change of the contact angle is large at a high temperature, not because the liquid evaporates at the high temperature and the seeming contact angle is reduced, but because the permeation is quickened since the liquid droplet quickly spreads at the high temperature. FIG. 2 shows the result of an experiment using ink containing a little amount of surface active agent. The composition of the ink employed in the experiment is as follows:

| | |
|---|---|
| food black 2 | 3.0% |
| thiogyglycol | 5.0% |
| glycerol | 5.0% |
| urea | 5.0% |
| isopropyl alcohol | 4.0% |
| acetylene alcohol | 0.1% |
| water | 77.9% |

Figure 3:
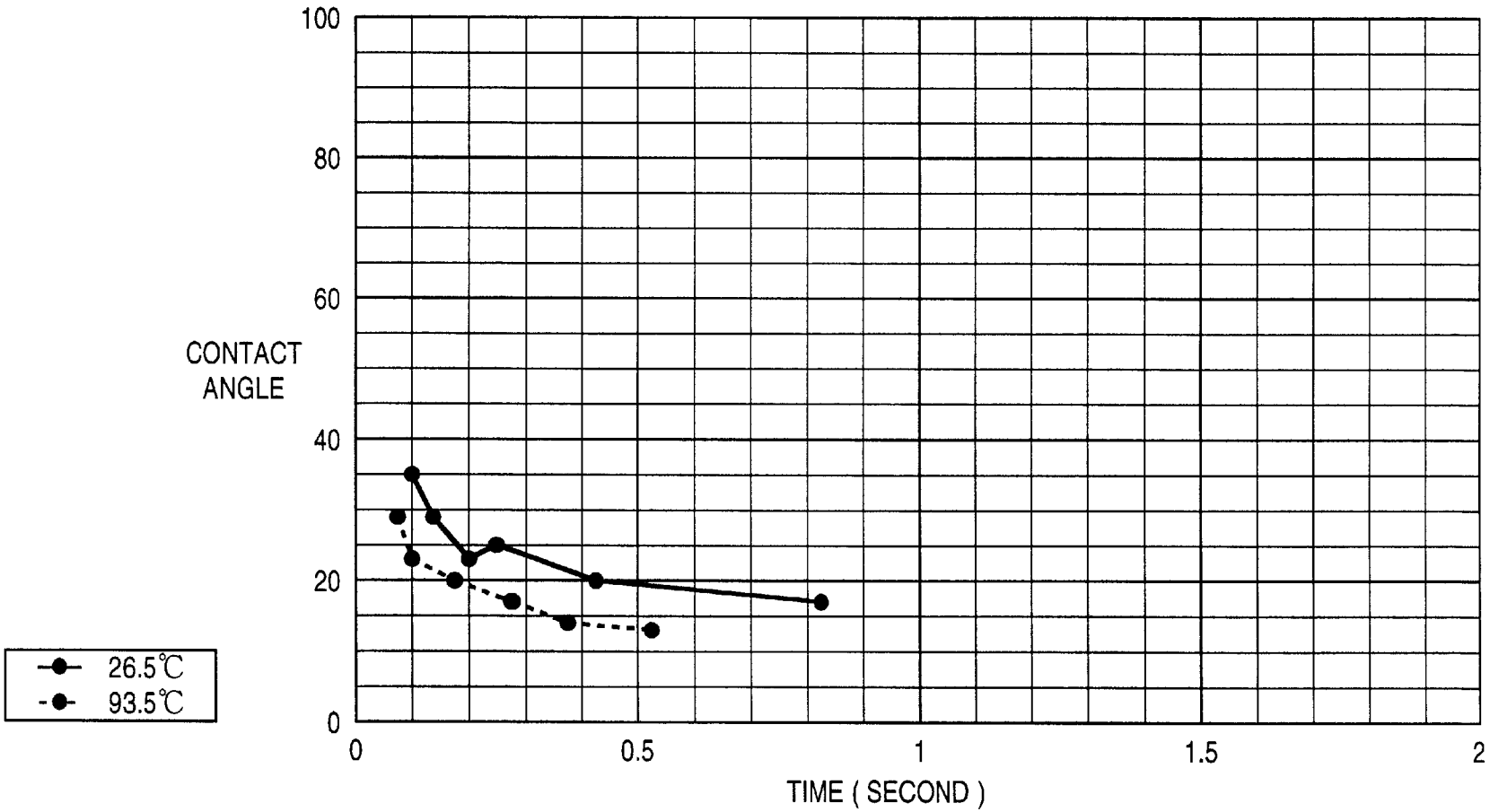

Further, FIG. 3 shows the contact angle of the above ink where the content of acetylene alcohol as the surface active agent is changed to 1%. As this ink has very high permeability, the change of the contact angle based on the temperature cannot be easily measured accurately. When printing a color image by using this ink, even at a border portion between different colors, a large part of the ink which has been first applied to that portion permeates into the paper before the subsequently discharged ink is attached to that portion. Accordingly, the probability of the occurrence of feathering or bleeding is comparatively low, and a high-quality image can be obtained. The paper employed in the experiment as shown in FIGS. 1 to 3 is normal paper PB PAPER (No. QKDA4) for copiers by Canon Kabushiki Kaisha.

The present embodiment controls the characteristics of the ink by heating control in accordance with respective parts of an image, so as to increase printing quality of characters and that of color images, in consideration of the fact that the permeability of liquid changes in accordance with the temperature of an object to which the liquid is applied. In the present embodiment, the ink having the temperature characteristic as shown in FIG. 2 is employed.

<Ink-Jet Printer>

Figure 18:
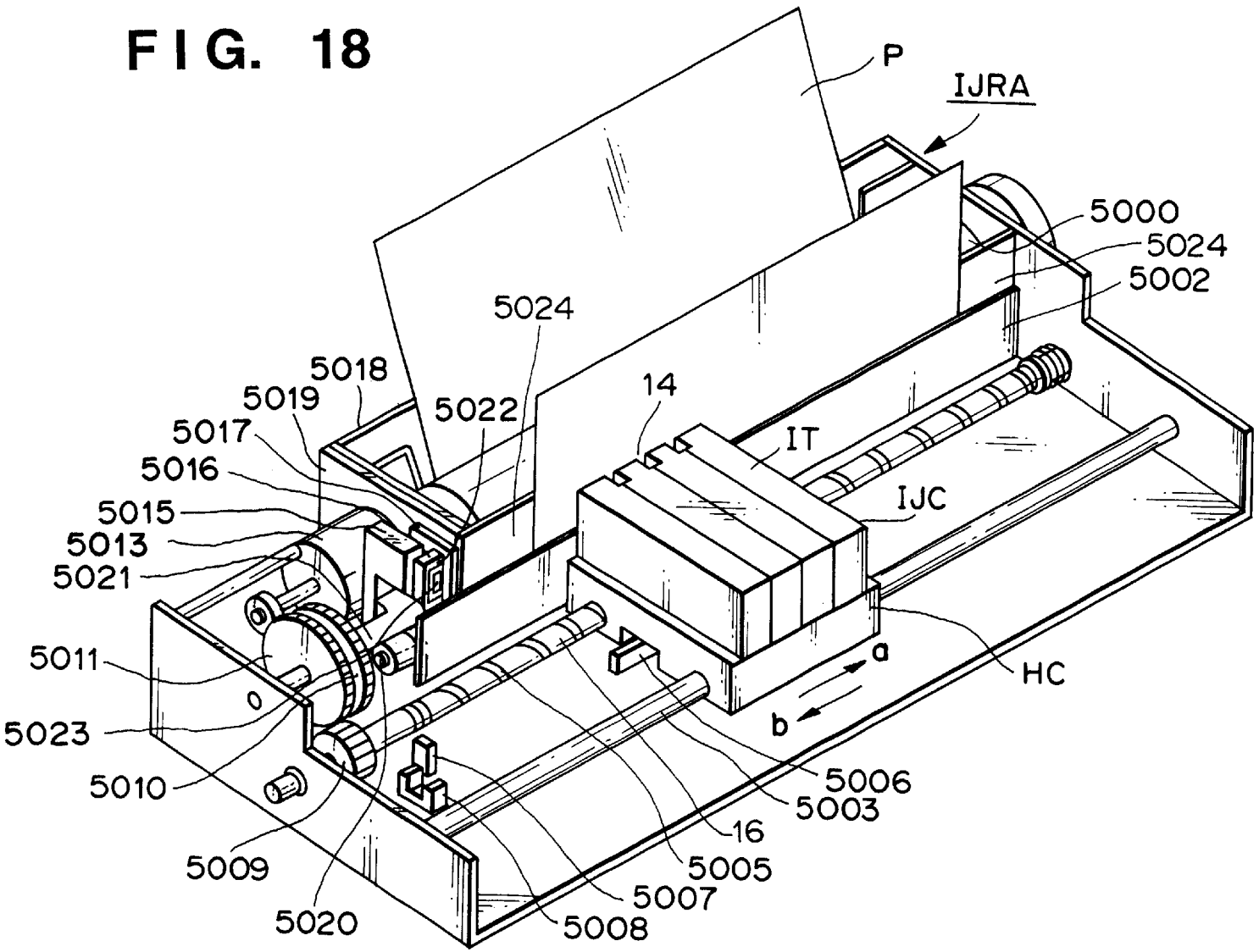
FIG. 18 is a perspective view showing an ink-jet printer.

FIG. 18 is a perspective view showing an ink-jet printer IJRA according to the present embodiment. In FIG. 18, a carriage HC is engaged with a spiral groove 5005 of a lead screw 16 which rotates via drive force transmission gears 5009 to 5011 interlocking with forward/reverse rotation of a drive motor 5013. The carriage HC has a pin (not shown), and it is reciprocally moved in the directions represented by arrows a and b. The carriage HC moves along the lead screw 16 and a guide shaft 5003. The carriage HC has an ink-jet cartridge IJC which comprises an ink tank IT and a printhead 14 having ink discharge orifices. The printhead 14 is a color ink-jet head where respective Y, M, C and K color heads are arrayed in a scanning direction.

A paper holding plate 5002, opposite to the head 14, presses the print sheet P against a platen 5000 along the moving direction of the carriage HC. Further, heaters to be described later are provided on another paper holding plate 5024 which holds the print sheet from the back side.

Photocouplers 5007 and 5008 detect a home position for confirming the existence of lever 5006 of the carriage in this area and changing over the rotational direction of motor 5013. A support member 5016 supports a cap member 5022 for capping the front surface of the printhead 14. A suction member 5015 performs suction-restoration of the printhead 14 by sucking the inside of the cap member 5022 via a cap inner opening 5023. A member 5019 allows a cleaning blade 5017 to move in a back-and-forth direction. A main body support plate 5018 supports the member 5019 and the cleaning blade 5017. It is apparent that any well-known cleaning blade is applicable to the printer of the embodiments. Numeral 5021 denotes a lever for starting the sucking operation of the suction-restoration. The lever 5021 moves along the movement of a cam 5020 engaged with the carriage HC. A well-known transmission mechanism such as change-over of a clutch controls a drive force from the drive motor.

When the carriage HC is at the home position area, a desired one of capping, cleaning and suction-restoration is executed at its corresponding position by the lead screw 16. Any of these processes is applicable to the printer, if a desired processing is performed at a well-known timing.

Figure 19:
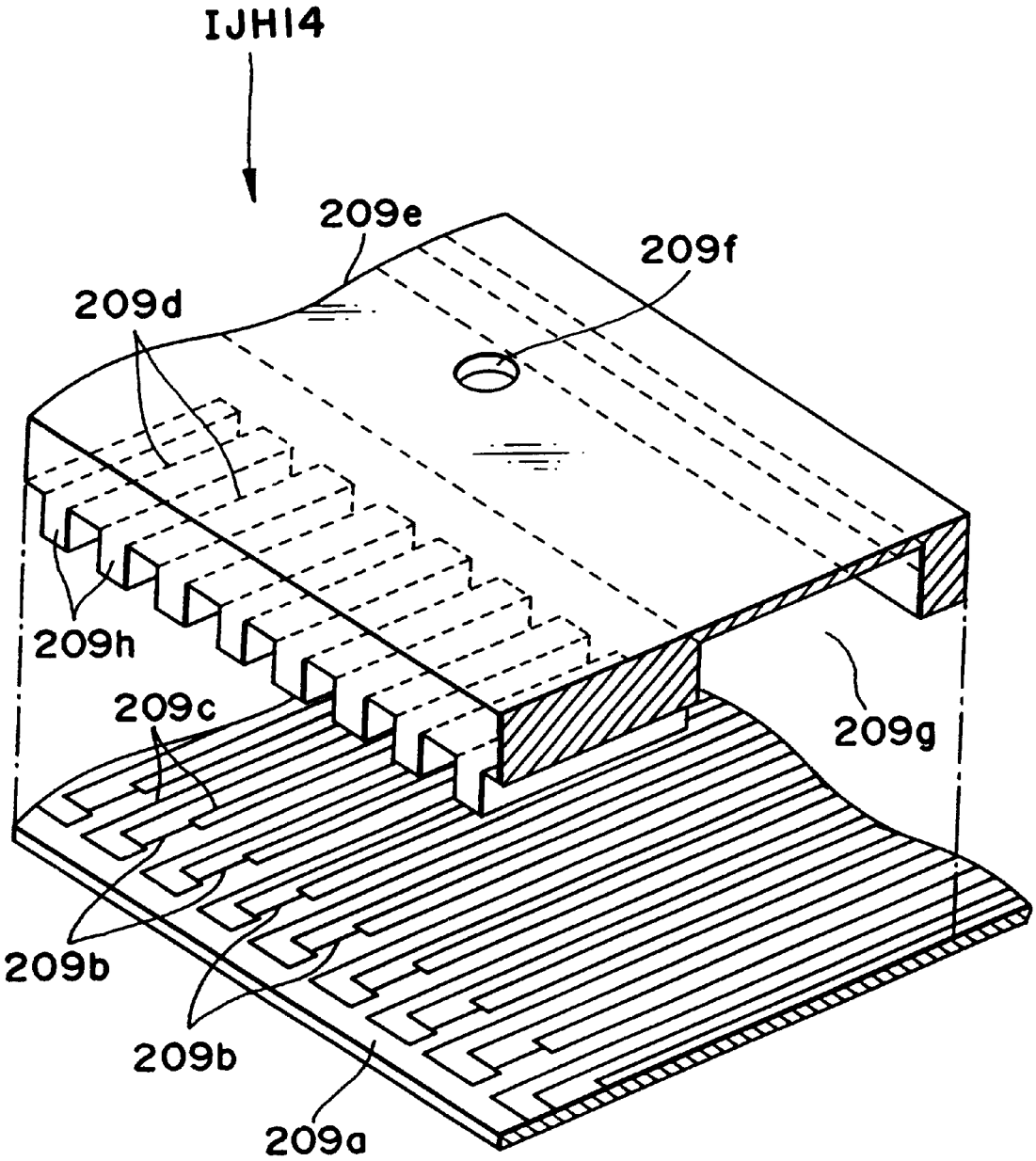
FIG. 19 is a perspective view showing the structure of a printhead of the ink-jet printer according to the embodiments.

FIG. 19 is a perspective view showing the printhead 14. In FIG. 19, reference numeral 209*a* denotes a heater board where electrothermal transducers (discharge heaters) 209*b* and electrodes 209*c*, made of aluminum or the like for supplying electric power to the electrothermal transducers 209*b*, are made by film-forming on a silicon substrate. The printhead 14 is assembled by attaching the heater board 209*a* to a top plate 209*e* having partition walls for separating liquid channels (nozzles) 209*d* for ink.

The ink supplied from the ink cartridge IJC via a conduit is filled into a common liquid chamber 209*g* in the printhead 14 from a supply port 209*f* provided in the top plate 209*e*, and introduced into the respective nozzles 209*d* from the common liquid chamber 209*g*. The nozzles 209*d* respectively have an ink discharge orifice 209*h*. The ink discharge orifices 209*h* are formed at a predetermined pitch in a sheet conveyance direction opposite to the print sheet.

<Heater>

Figure 4:
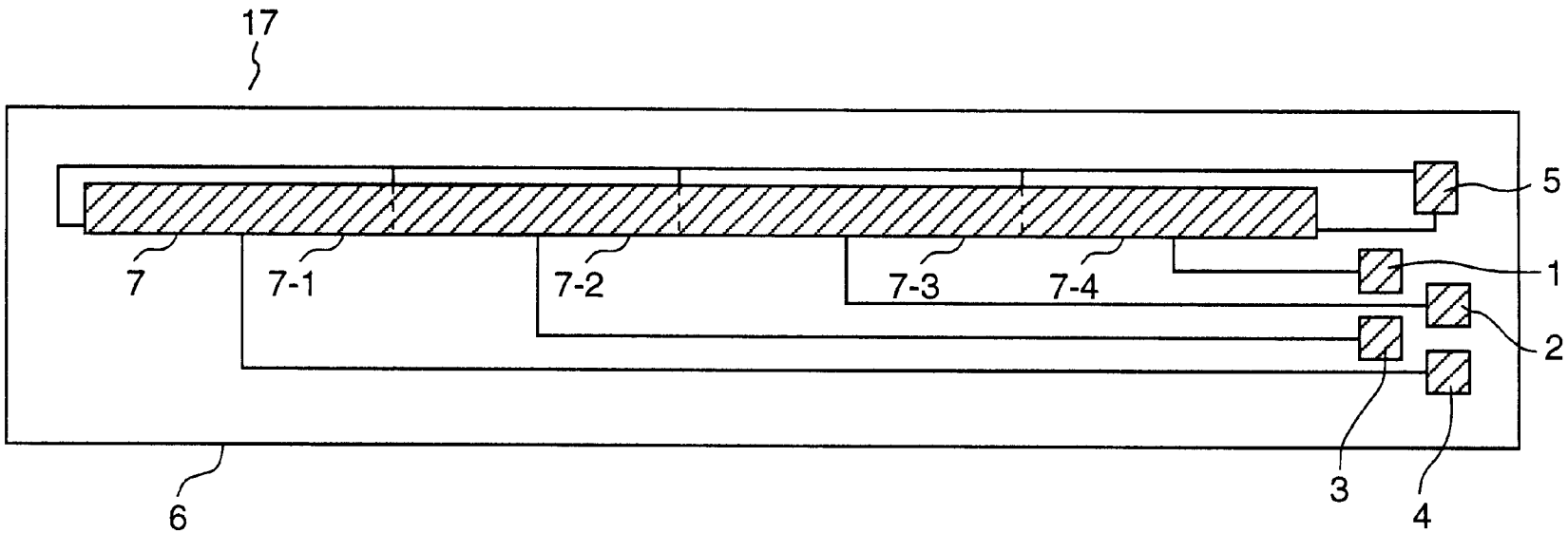
FIG. 4 is a schematic view showing a heater for heating paper according to an embodiment of the present invention.

Next, a heater for heating the print sheet will be described. FIG. 4 shows the heater used in the printer of the present embodiment. A heater 17 has a heat generating resistor 7 on an alumina substrate 6 having a thickness of about 0.7 mm, a width of 7 mm and a length of 30 cm, although the size changes depending on the size of the printer. The heat generating resistor 7 is formed by coating a paste of an alloy powder of silver and palladium, or the like, into a slim line shape having a thickness of about 10 $\mu$m and sintering the paste. Further, a film having a thickness of about 10 $\mu$m is formed on the above line by coating the line with a paste of borosilicate glass or the like having high insulation characteristics and sintering the paste. Further, a cover glass layer having a thickness of 10 $\mu$m is formed by coating the above film with a paste of lead glass powder or the like and sintering the paste. The cover glass layer provides the heat generating resistor 7 with durability against abrasion caused when passing the print sheet over the resistor 7. In FIG. 4, the heat generating resistor 7 is a single line divided into four segments 7-1 to 7-4 by wiring electrodes 1 to 5 at four parts. The segments are independently controlled.

Figure 5:
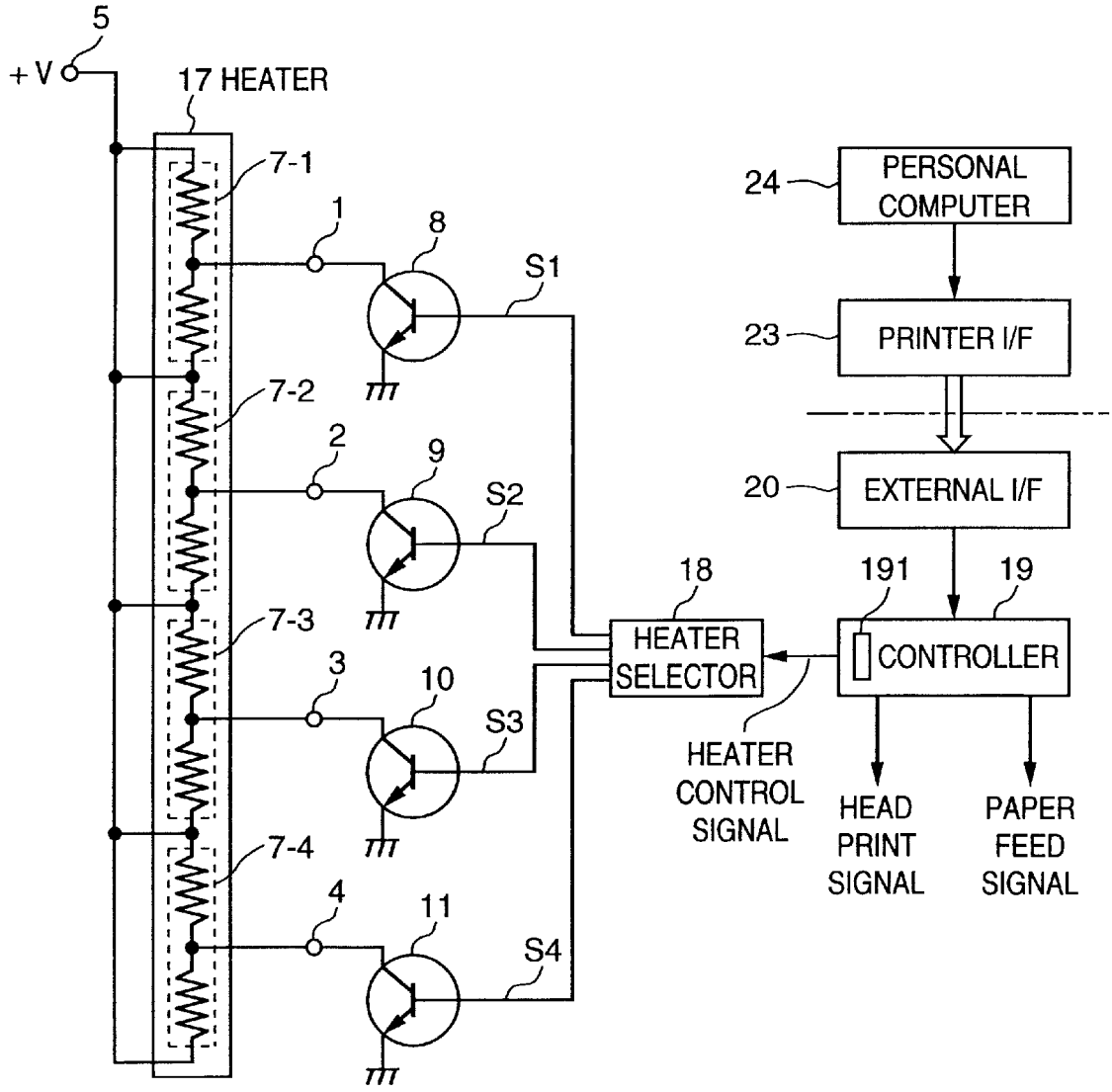
FIG. 5 is a block diagram showing the construction of the heater.

FIG. 5 shows the wiring of the heater 17. The respective resistors are grounded via the electrodes 1 to 4 and drive transistors 8 to 11. The electrode 5 is connected to the power of the heater 17. When any of the transistors 8 to 11 is ON or in an operating state, current flows to a heat generating resistor connected to the collector of the transistor, and a heater segment including the resistor generates heat. If any of selection signals S1 to S4 is inputted via a heater selector 18 into the base of the corresponding transistor, the segment connected to the ON transistor generates heat. For example, if the transistor 8 is turned ON, current flows to the resistor connected to the collector of the transistor 8, and the heater segment 7-1 including the resistor generates heat.

Figure 6A:
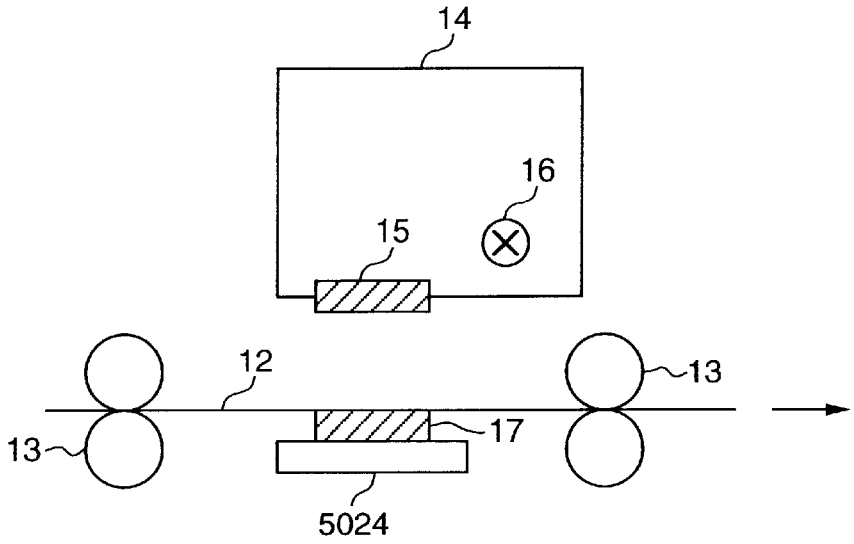
FIGS. 6A and 6B are schematic views showing the relation among a printhead, a print medium and the heater.
Figure 6B:
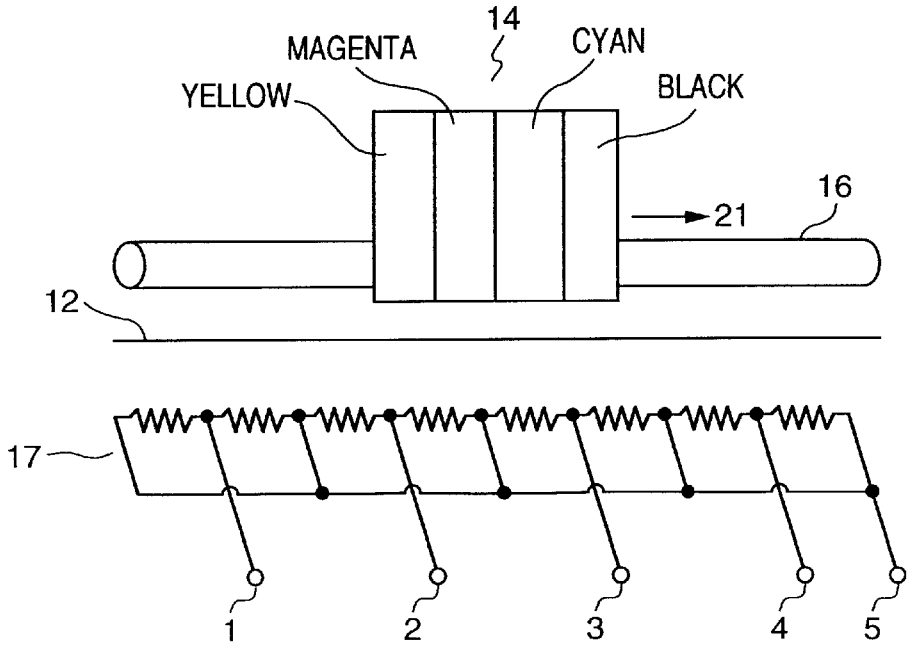

FIG. 6 schematically shows the arrangement of the printhead and the heater. In this printer, a print medium 12 is conveyed by conveyance rollers 13 while the print medium 12 comes :into contact with the heater 17, and the print medium 12 is heated from the rear surface side. On the other hand, the printhead 14 is guided by the lead screw 16 along a lengthwise direction of the heater 17, while sequentially discharging ink droplets from the nozzles 15 based on print information, thus forming an image on the print medium 12. Note that the lengthwise direction of the heater 17 is a direction vertical to the FIG. 6A and is represented by an arrow 21 in FIG. 6B. Further, paper feed is performed in a necessary amount via the conveyance rollers 13 or a feeding device, then the next line is printed by scanning of the printhead 14. At this time, the heater 17 at the rear side heats the paper to a predetermined temperature, thereafter, ink droplets discharged from the printhead 14 are attached to the paper.

Figure 7:
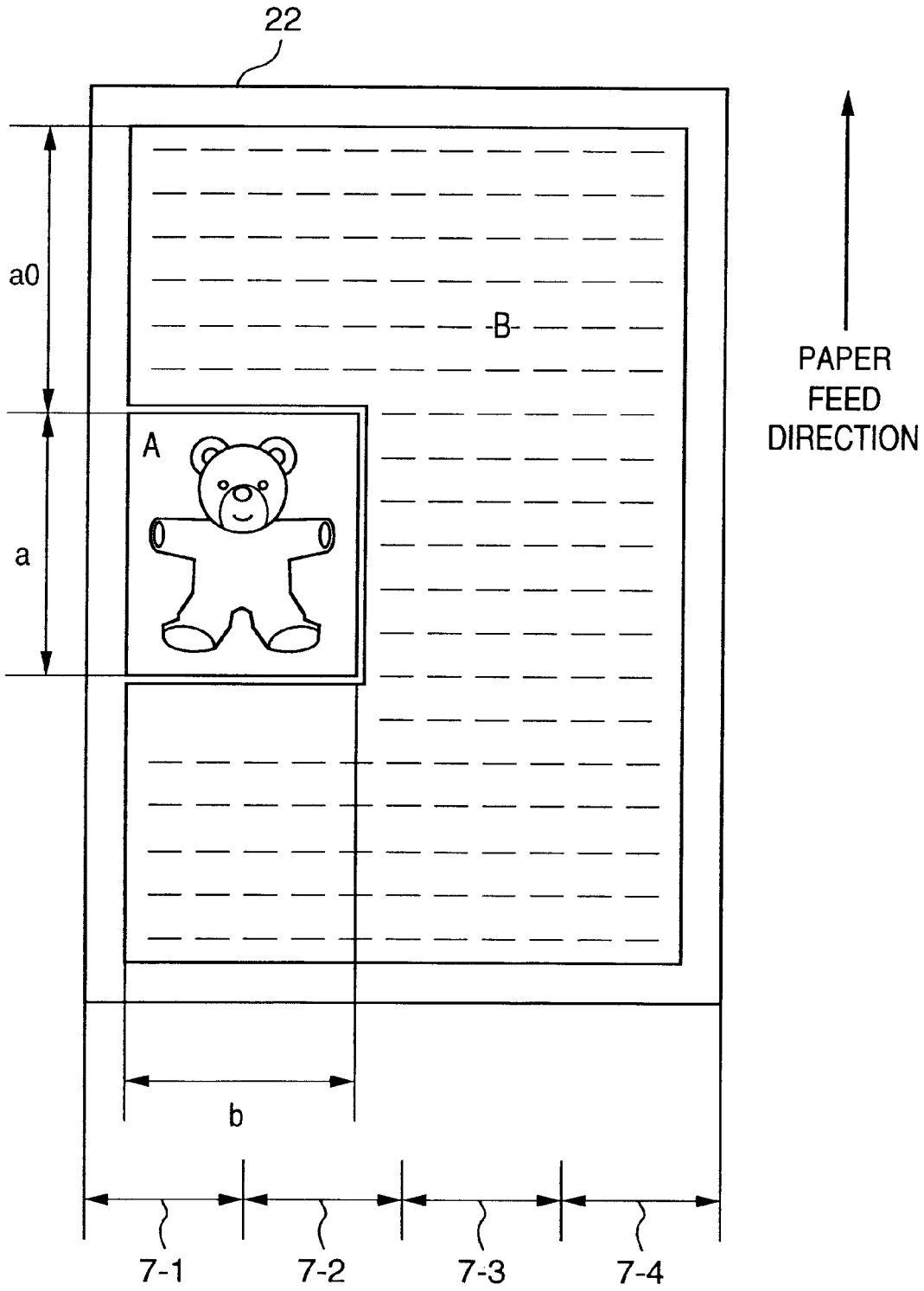
FIG. 7 is an image sample in printing.

In this case, the operation status of the heater 17 differs in accordance with image type. For example, as shown in FIG. 7 to obtain a printed sheet 22 including an area A having a color complicated pattern such as a photograph or an image and a character area B, while a portion indicated by a length a passes over the heater 17 along the paper feed direction, the transistors 8 and 9, for example, are turned ON to electrify the heat generating resistors corresponding to the area A of the paper indicated by a widthwise direction b and to cause the heater segments 7-1 and 7-2 to generate heat. This series of controls is made by a controller 19 (FIG. 5). That is, the controller 19 sends a signal to the heater selector 18 in synchronization with the paper feed control, based on print information including area designation information of the image received from an external device such as a personal computer 24 (See FIG. 5). The print information is sent from the personal computer 24 through a printer interface 23 and an external interface 20, e.g., a printer cable according to the Centronics interface. Accordingly, a user only sets an area designation (control information to control the heater 17 as a result) of an image for ink spread control, on a software such as a printer driver of a personal computer, in accordance with a document to be printed. Otherwise, it may be arranged such that the printer driver automatically discriminates an image area from a character or figure area and sets area designation, thus omitting the user's labor.

<Heater Control>

Next, procedures of controlling the heater will be described with reference to FIGS. 20 and 21 which are flowcharts showing the control procedures performed by the controller 19.

Figure 20:
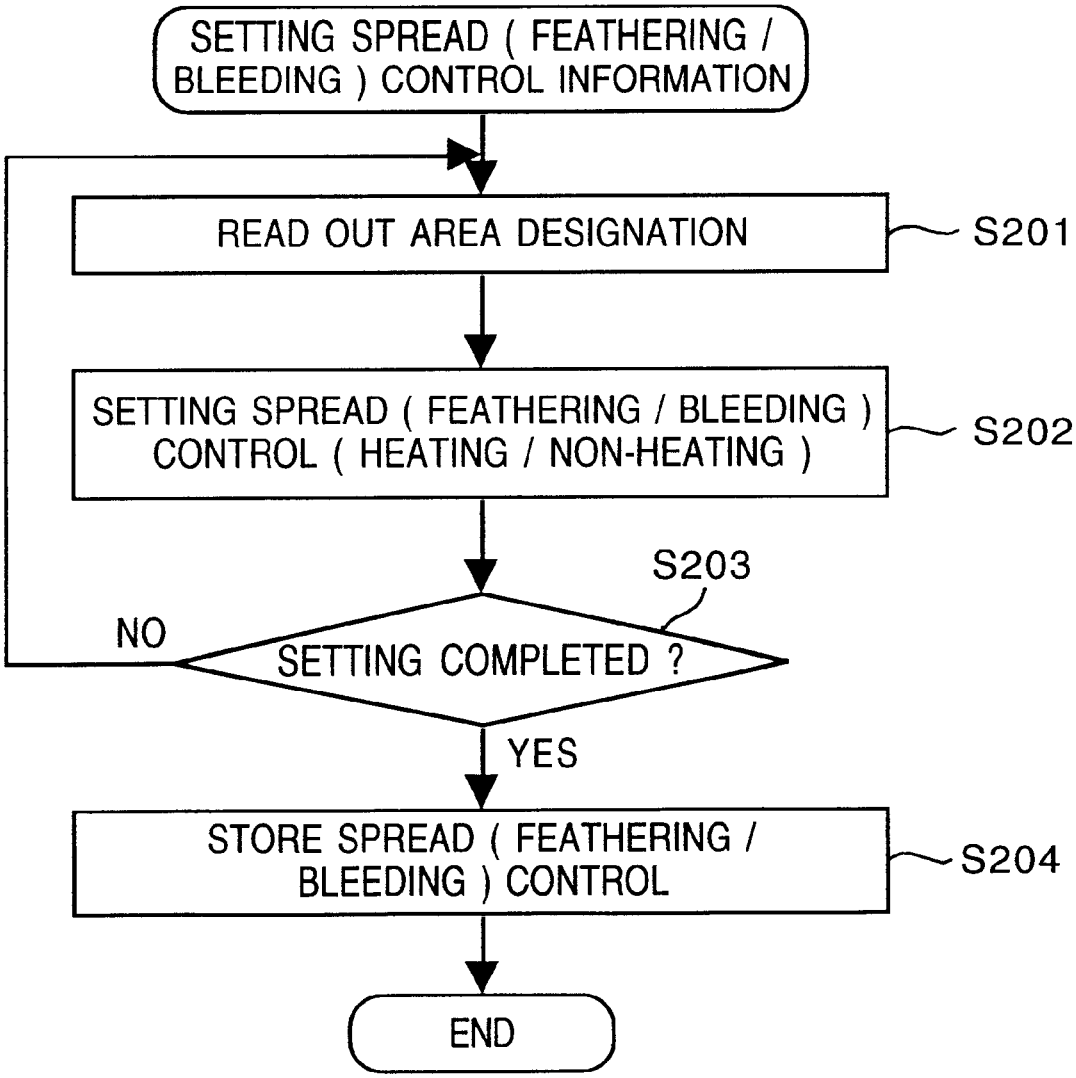
FIG. 20 is a flowchart showing a procedure of setting feathering control information.

In FIG. 20, first, area designation information received with image information is read out (step S201). As the area designation information, the image type such as natural image, character information and figure information may be designated, the designation may be made by simply discriminating a natural image from other information, or the designation may be made based on whether heating is performed or not. In a case where image data is received in the form of page description language, discrimination can be made based on the type of the data without specific designation.

When the area designation information has been read out, spread control information, i.e., information indicating whether heating by each segment of the heater 17 is performed or not for ink spread control, is set based on the area designation information (step S202). For example, the control information is set such that heating is not performed with respect to areas of characters and line art, while heating is performed with respect to an area of bitmap image. In the case of FIG. 7, the control information is set in accordance with the image type such that heating is not performed with respect to a0 lines from the beginning of the page, then, with respect to a lines, heating is performed by electrifying the heater segments 7-1 and 7-2 corresponding to the width b, and with respect to the remaining lines, heating is not performed to the end of the page. In this example, as heating is performed for an area corresponding to a segment which is a ¼ part of the heater 17, as a unit, the control information is managed as binary information obtained by dividing information for one line (area printed by one scanning of the printhead) by four. If an A4 sized page is printed by 40 scannings, i.e., 40 lines, spread control information of 4×40=160 bits per page is set.

When the setting of the spread control information for the image to be printed has been completed (YES at step S203), the information is stored into a predetermined storage area 191 (See FIG. 5), and the procedure ends (step S204).

Note that the end of the segment of the heater 17 does not always correspond to the end of an image area. In this case, heating/non-heating is determined based on the ratio between image areas corresponding to one heater segment. In this example, heating/non-heating is determined while giving priority to the larger area.

Figure 21:
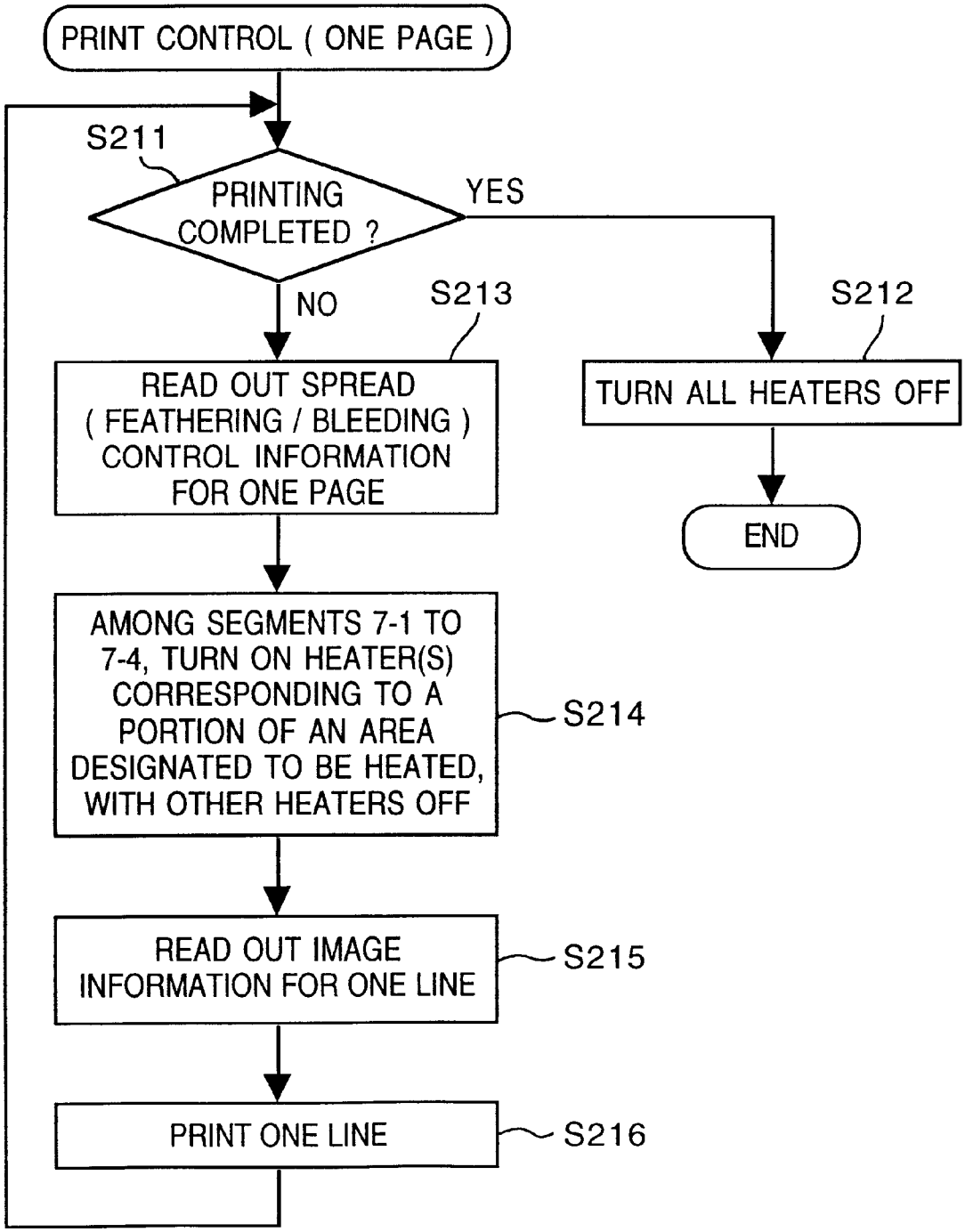
FIG. 21 is a flowchart showing a procedure of controlling the paper heater.

FIG. 21 shows a control procedure by the controller 19 for the heater 17 and the printhead 14 for printing one page. First, before scanning, it is determined whether or not printing has been completed (step S211), and if the printing has been completed, all the heaters are turned off (step S212). If a line(s) to be printed remains, 4-bit spread control information corresponding to the line to be printed is read from the storage area 191 (step S213). The information is outputted from the heater selector 18, the transistor of the segment(s) (any of the segments 7-1 to 7-4) corresponding to an area designated to be heated, is turned on, and thus heating is performed (step S214). Thereafter, image information of the line to be printed is read out (step S215), and the line is printed (step S216). Since this procedure is for one page, in the case of printing a plurality of pages, the procedure is repeated for the number of pages.

By the above controls, ink attached to a non-heated area slowly permeates into the paper, as shown in the measurement results of FIGS. 1 and 2, thus a sharp character image without feathering is formed. On the other hand, ink attached to a heated area immediately permeates into the paper, so that it does not quickly mix with subsequently attached ink, thus an image having excellent color development without bleeding is formed. In this manner, both high-quality image printing and high-quality character printing can be realized. In the image in FIG. 7, heating is performed with respect to the natural image area A, while heating is not performed with respect to the character area B. Ink quickly permeates into the paper at the natural image area A, thus forming a high-quality image where bleeding is suppressed. The ink does not quickly permeate into the paper at the character area B, thus characters with sharp outlines and without feathering can be printed.

Figure 22:
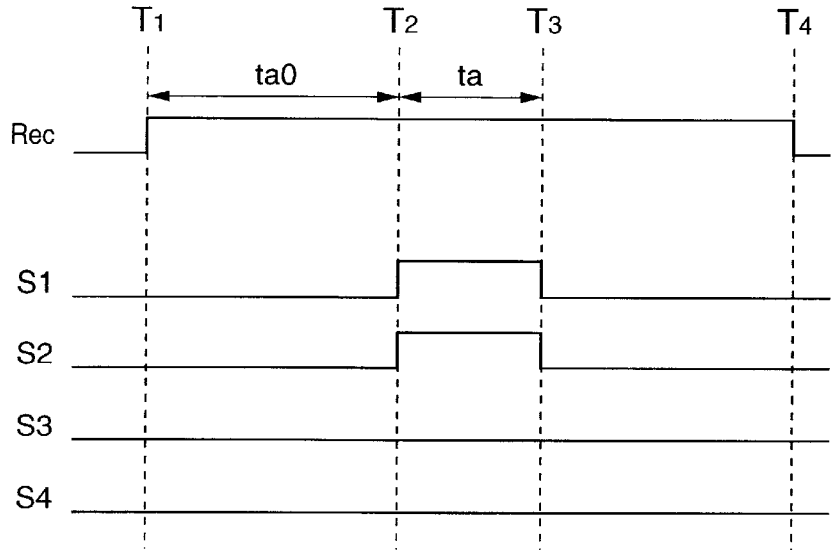
FIGS. 22 and 23 are timing charts showing an example of a procedure of controlling the paper heater.

FIG. 22 is a timing chart showing the heater control when printing a document in FIG. 7. When signals are applied to the selection signal lines S1 to S4, the transistors 8 to 11 corresponding to the respective signals become ON, the heater segments 7-1 to 7-4 are electrified, and the heater segments generate heat. In FIG. 22, when a signal Rec which indicates that printing is performed with respect to a print sheet becomes ON at timing T1, printing is started. Thereafter, when a period ta0 for conveying the print sheet by the length a0 has elapsed, the signals S1 and S2 become ON at timing T2. This state is maintained for a period ta for conveying the print sheet by the length a, and the signals S1 and S2 become OFF at timing T3. Accordingly, the heater segments 7-1 and 7-2 generate heat while printing is performed by the length a from timing T2 to timing T3. Thereafter, the printing ends in the state where all the heaters are OFF.

In this manner, ink spread can be controlled by the heater.

In the experiment where the Canon ink-jet printer BJC820J was improved and the ink having the characteristics represented by the measurement results shown in FIGS. 1 and 2 was used, spread control is greatly effective when the surface temperature of the heater 17 is about 90° C. The higher the temperature, the greater the effect of the spread control becomes; however, it is desirable that the temperature is low from the point of energy savings. Accordingly, the temperature may be determined in consideration of the arrangement of ink, the design of the printer and printing effect. For example, the ink having characteristics represented as the measurement results in FIG. 3 has very quick permeability; therefore, spread control is not effective at a low temperature. However, an image with a very high quality can be obtained when the temperature is set to 200° C. Note that at a high temperature, if a paper jam or the like occurs, the paper may burn. For this reason, the addition of a penetrating agent to the ink must be controlled in consideration of the above situation.

As described above, the ink-jet printer of the present invention controls the permeation of the ink by controlling to totally or partially heat the surface of the paper in accordance with the feathering/bleeding control information, and the printing effect which more satisfactorily responds the user's intention can be attained. In the present embodiment, feathering and bleeding have been described as undesirable effects; however, these effects should be evaluated by the user, and it is more desirable that the user can control the feathering and bleeding in accordance with his/her preference. The printer of the present invention is intended to control the physical characteristics of ink by heating the paper in accordance with an image part so as to obtain various effects. Thus, an effect utilizing spread, for example, can be enhanced in an image.

Figure 23:
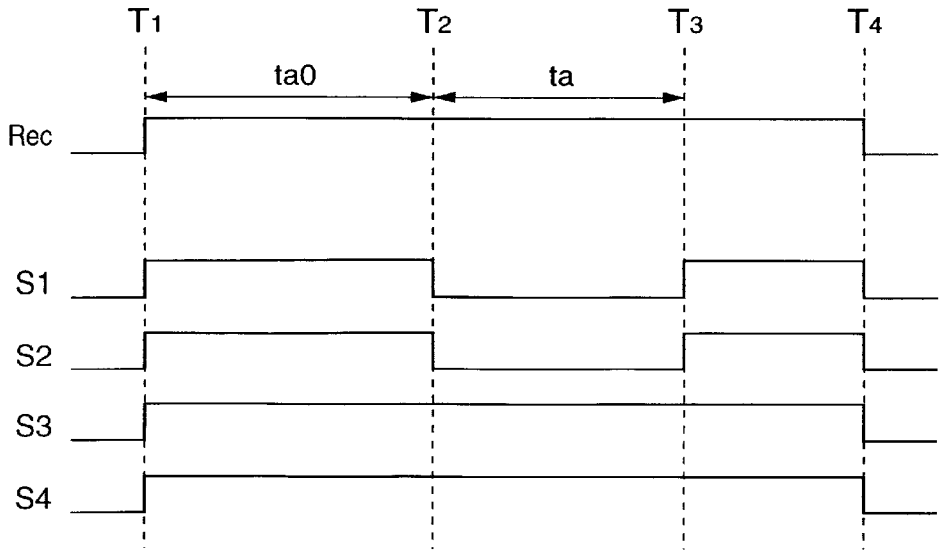

Further, as proposed in Japanese Patent Application Laid-Open No. 8-333534 by the present inventor, a further improved effect can be attained by using ink having a high polymer agent which has a reversible viscosity-improving characteristic with respect to heat. This high polymer agent dissolves in water at a low temperature; however, because phase separation occurs at a predetermined or higher temperature, it separates from the water and shows high viscosity. The ink is not different from ordinary ink until it is discharged from an ink-jet printer; however, on a print medium having an increased temperature, it fixes color matter on the surface layer of the print medium with its viscosity. At this time, as the temperature of the print medium is high, the permeability of the ink is suppressed. Thereby characters can be printed with high quality. In this case, the driving patterns shown in FIG. 23 for the heater segments 7-1 to 7-4 are appropriate for printing the image of FIG. 7. In this method, as the temperature causing phase separation can be freely controlled by controlling the combination of the high polymer and water, the permeability of the ink with respect to a print medium can be easily controlled, and a remarkably improved effect can be expected by combining this ink with the heating method of the present invention. In this case, the heating method must be appropriate to the ink.

In this manner, it is preferable to generate spread control data in accordance with the characteristics of the ink. Further, as the permeation of ink with respect to a print medium changes corresponding to the characteristics of the print medium, it is also preferable to generate spread control data in accordance with the characteristics of the print medium. Further, it is more preferable to generate spread control data based on at least two of the types of images, the characteristics of the ink and the characteristics of the paper. Further, by applying the present invention to an ink-jet printing using ink containing a diffused pigment, dispersive destruction of the pigment can be caused by the heat. By controlling the dispersive destruction of the pigment, the pigment can be totally or partially fixed to the surface of a print medium, which greatly improves the possibilities of printing expressions. It is also possible to use both the pigment and a dye.

[Other Embodiments]

Figure 8:
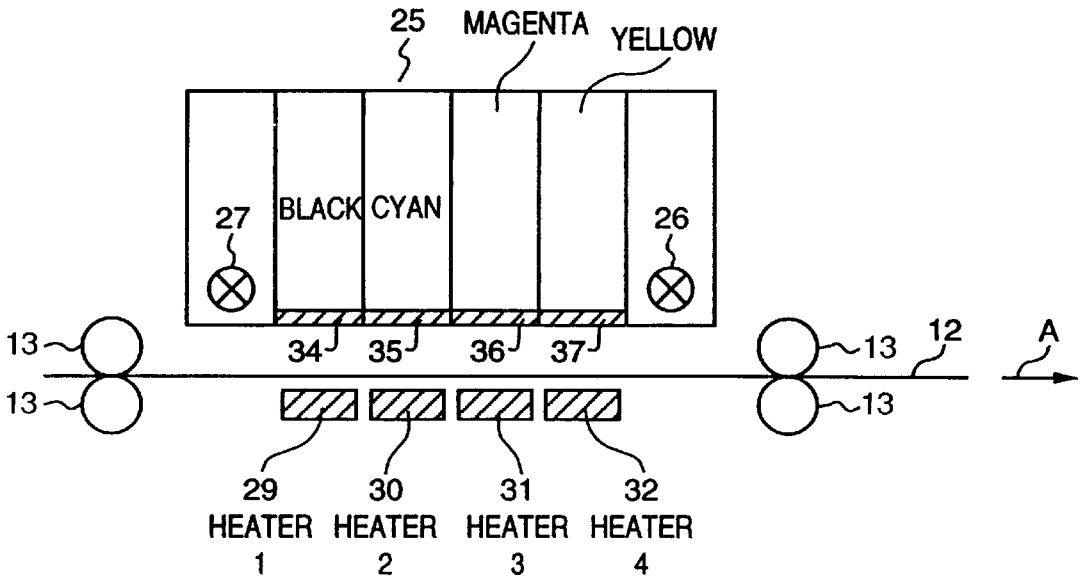
FIG. 8 is a schematic view showing another embodiment of the present invention.

FIG. 8 shows another embodiment of the present invention. In this example, heads 34 to 37 for discharging ink of respective colors are arrayed in a direction vertical to lead screws 26 and 27, i.e., a sheet conveyance direction. That is, four adjacent scan lines can be printed in different colors by one scanning of the printhead 25. Each color head appropriately has an array of plural nozzles. In this construction, a plurality of heaters 29 to 32 can be arrayed along the sheet conveyance direction, for ink spread control for respective colors. The amount of information is large (four times greater than that in the first embodiment) because the spread control information for controlling the heater is required for the respective colors; however, the printing quality for images of the respective colors is improved.

Figure 9:
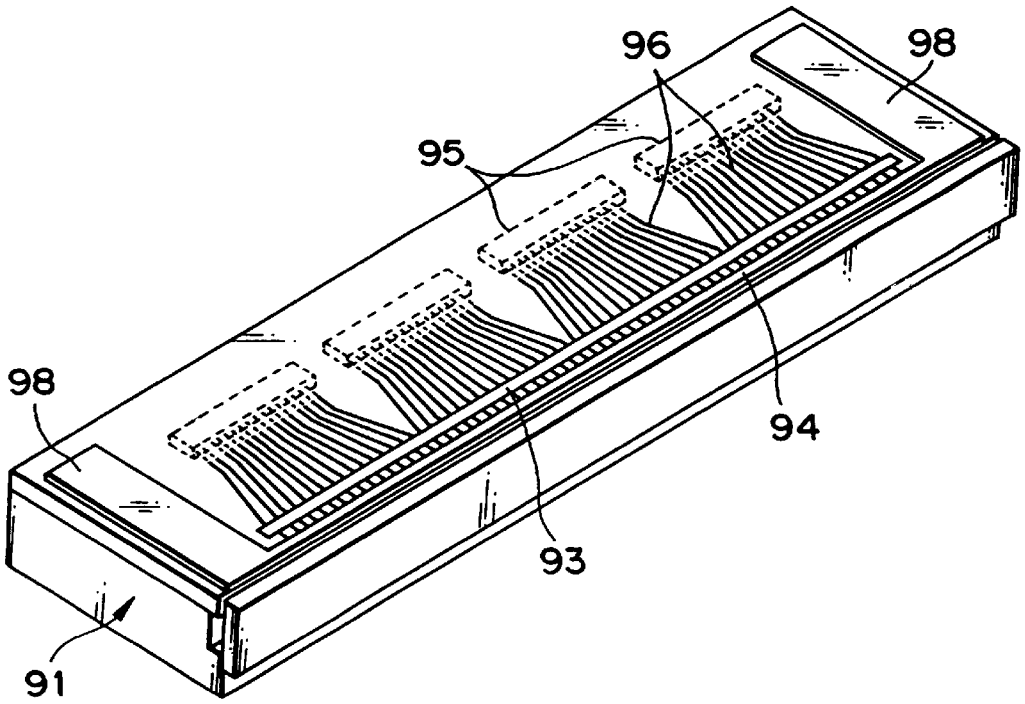
FIG. 9 is a perspective view showing the structure of a line-type heater.

FIG. 9 shows another embodiment of the present invention. In this example, the heater 17 of the first embodiment is replaced with a line type head which is used in so-called thermal transfer type and sublimation type printers. In FIG. 9, a line heat generating resistor 93, which is covered with a protective layer, is provided in a direction orthogonal to a scanning direction of the printhead on an insulating substrate 91. Regarding a line direction, the heat generating resistor 93 has a width corresponding to one pixel of the printhead, and regarding a height (subscanning) direction, it has a width corresponding to the width of one scan line, i.e., the width of the nozzle array of the printhead. The respective heat generating resistors for one scan line are connected to a common electrode 94 and separate electrodes 96, and are driven by a drive IC 95 which drives the respective heat generating resistors connected to the separate electrodes 96. The driving principle of the drive IC 95 is similar to that of the heater selector 18 and the transistors 8 to 11 shown in FIG. 5, and it can be considered that in this case, the heater segments 7-1 to 7-4 respectively have a width corresponding to a printing element of the printhead. A power supply electrode 98 applies a predetermined drive voltage to the common electrode 94.

Figure 10:
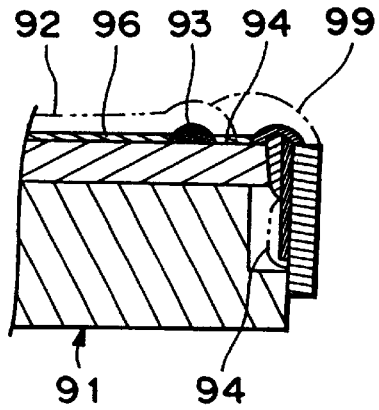
FIG. 10 is a cross-sectional view of the line-type heater.

FIG. 10 shows the cross section of this printhead. In FIG. 10, the elements corresponding to those in FIG. 9 have the same reference numerals. The heat generating resistor 93 is covered with a glass coat 92. The electrode 94 and the like not in contact with the heat generating resistor 93 are covered with a resin coat 99.

By using this heater, regarding the subscanning direction, the permeation of ink can be controlled by pixel units. In this case, the spread control information set at steps S202 and S204 in FIG. 20 has a binary value indicative of heating/non-heating corresponding to one pixel width.

Figure 11:
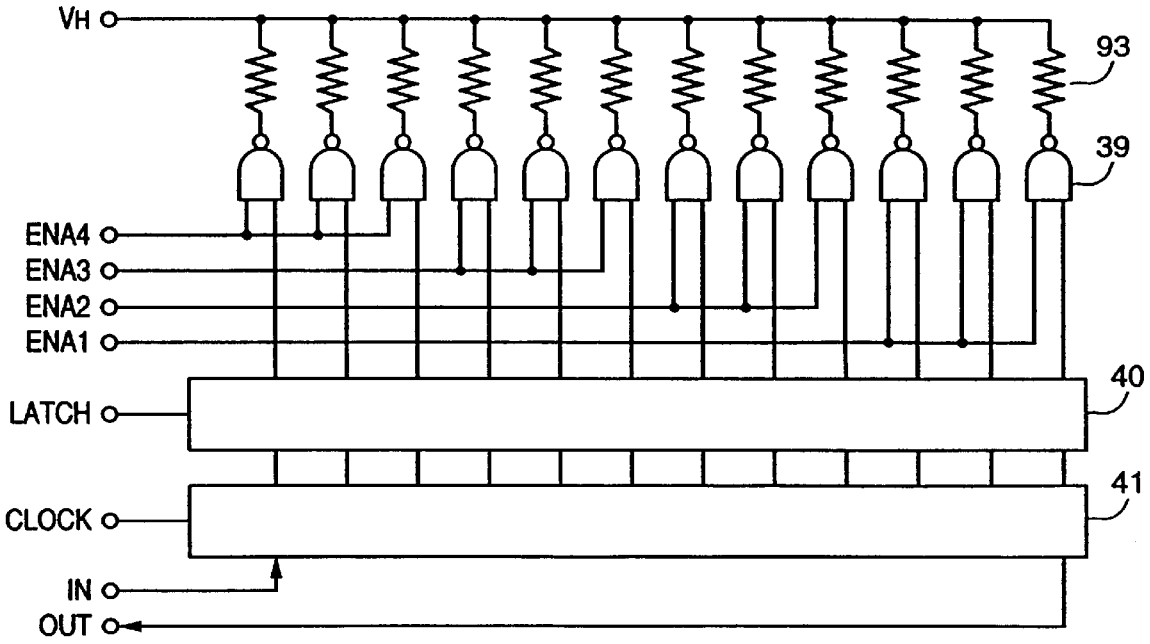
FIGS. 11 and 12 are block diagrams respectively showing the construction of a controller of the line-type heater.
Figure 12:
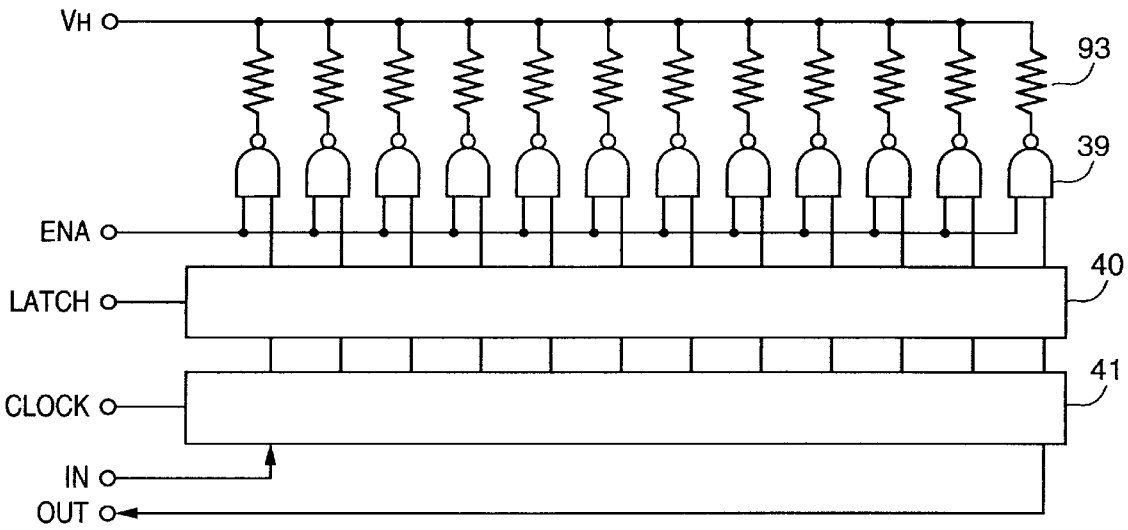

FIGS. 11 and 12 show examples of driver circuits for this type of heater. The heat generating resistor 93 performs control by inputting a signal stored in a shift register 41 via a latch 40 into a gate 39 which is controlled by an enable signal. The shift register 41 receives a signal indicating a heater to be turned on. In this example, as the number of heaters is very large (e.g., 360 dpi) in comparison with those in FIG. 5, finer ink spread control is possible. FIG. 12 shows an example where an enable signal is commonly used for all the heat generating resistors. This configuration attains simple construction and control; however, in the case of a large number of heat generating resistors, it increases the amount of heat generation and electric consumption of the circuit.

Figure 13:
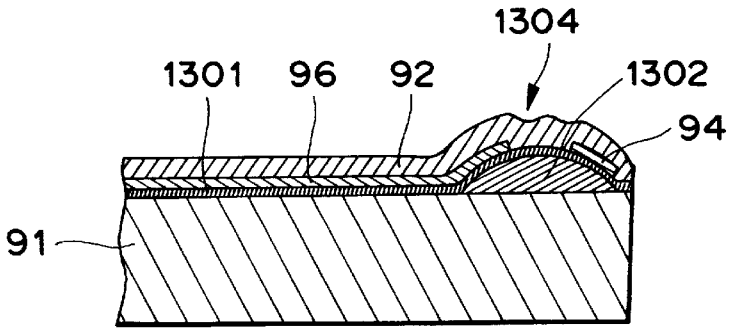
FIGS. 13 to 16 are cross-sectional views of the line-type heater.

FIGS. 13 to 16 show cross-sections of heaters used in these embodiments. In FIG. 13, a glaze layer 1302 is formed on the substrate 91, and a resistive film 1301 is formed on the glaze layer 1302. The resistive film 1301 is connected to the common electrode 94 and the separate electrodes 96, and connected to the circuit as described in FIG. 9 for a similar control. The top of the resistive film 1301 is a heat generating portion 1304. The heat generating portion 1304 is covered with a protective film 92.

Figure 14:
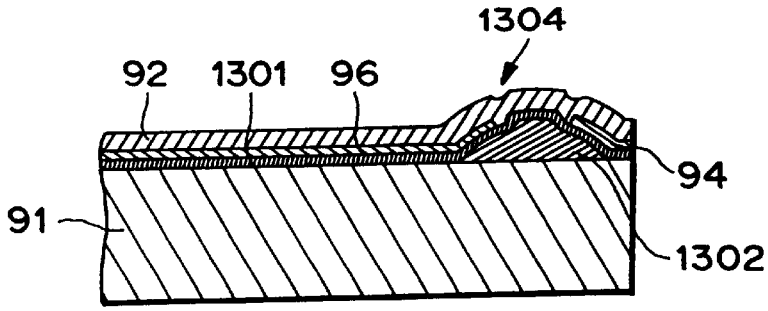
Figure 15:
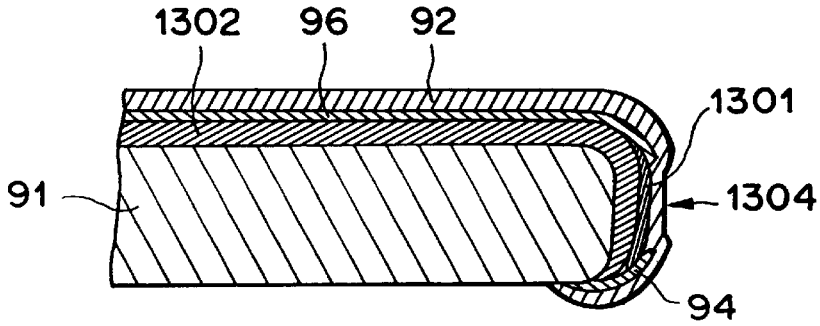
Figure 16:
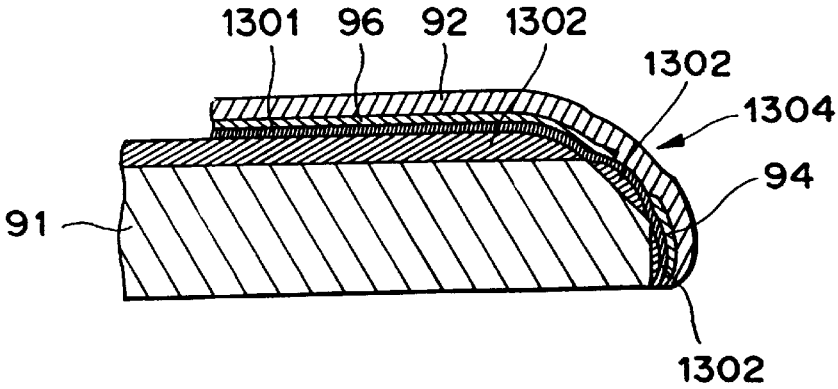

In FIGS. 14 and 15, the elements corresponding to those in FIG. 13 have the same reference numerals. In these figures, the position and the entire shape of the heat generating portion 1304 is different from that in FIG. 13, and the shape of the heater can be selected from various shapes in accordance with the construction and shape of the ink-jet printer.

Figure 17:
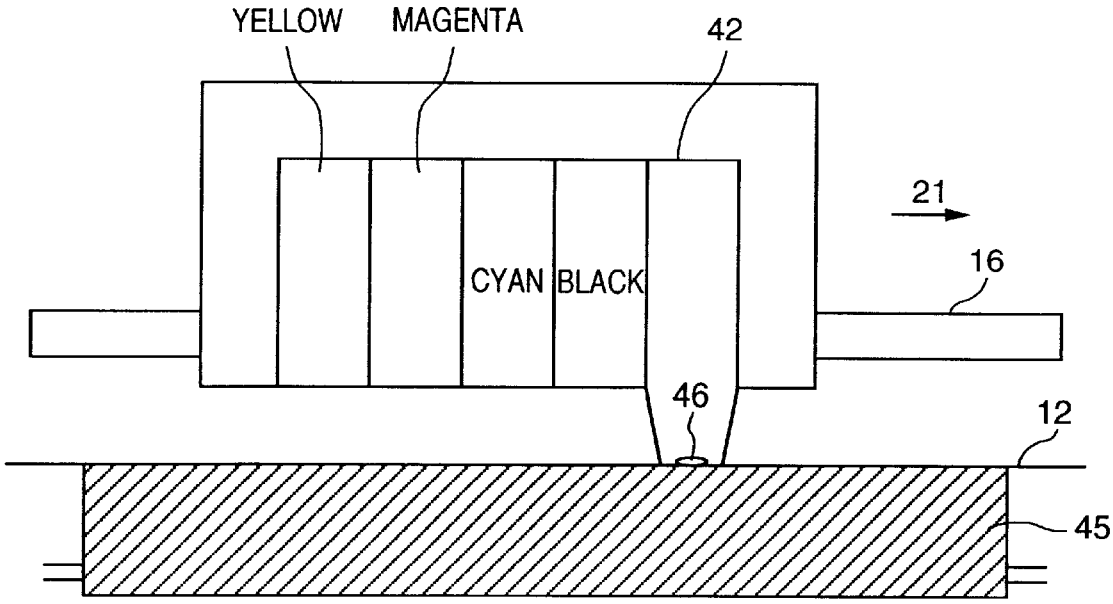
FIG. 17 is a schematic view showing an example where a scanning-type thermal head is used.

FIG. 17 shows another embodiment of the present invention. In this example, a heater 46 utilizes a thermal-transfer type printhead similar to the above example. Note that the heater 46 utilizes, not the line-type but a scanning-type thermal-transfer printhead. A printhead 42 has heads for discharging respective black ink, cyan ink, magenta ink and yellow ink, and the heater 46 is at a position at the head of scanning. The heater 46 has a length corresponding to the width of the nozzle array of the head in the sheet conveyance direction. The heater 46 may be a single heater having the above length or may be a plurality of heaters each having a width corresponding to a print pixel and may be independently controlled. The heater 46, opposite to a platen 45, rubs the print medium 12 and heats the surface of the print medium, so as to perform ink spread control in accordance with spread control information. This method attains a good heat efficiency because the print medium is heated from the printed surface side.

Further, in a case where the printhead scans in back-and-forth directions, the heater 46 may also be provided at the left side of the yellow head, and the heater to be used is changed in accordance with the scanning direction.

As described above, the ink-jet printer of the embodiments controls ink spread with respect to paper, in accordance with the image type. This prevents bleeding, regarding a natural image where a plurality of color inks is used to print closely adjacent portions, while preventing feathering of outlines by slowing the permeation of the ink, regarding an image where characters or the like are to be clearly printed. Thus, it print-outputs high quality images.

[Further Embodiments]

The present invention can be applied to a system constituted by a plurality of devices (e.g., host computer, interface, reader, printer) or to an apparatus comprising a single device (e.g., copy machine, facsimile).

Further, the object of the present invention can be also achieved by providing a storage medium storing program codes for performing the aforesaid processes to a system or an apparatus, reading the program codes with a computer (e.g., CPU, MPU) of the system or apparatus from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides where the aforesaid functions according to the above embodiments are realized by executing the program codes which are read by a computer, the present invention includes a case where an OS (operating system) or the like working on the computer performs a part or the entire process in accordance with designations of the program codes and realizes functions according to the above embodiments.

Furthermore, the present invention also includes a case where, after the program codes read from the storage medium are written in a function expansion card, which is inserted into the computer or in a memory provided in a function expansion unit which is connected to the computer, CPU or the like, the function expansion card or unit performs a part or the entire process in accordance with designations of the program codes and realizes functions according to the above embodiments.

Further, in the above embodiments, spread control data is generated in consideration of the spread of the ink, that is, feathering, bleeding or the like; however, it may be arranged such that permeation control data is generated in consideration of the permeation of the ink with respect to a print medium.

Further, in the above embodiments, binary data is employed as the control data to turn on/off the heater; however, multivalued data may be employed for multiple-step control on a heating state of the heater. In this case, finer heating control can be performed.

The present invention is not limited to the above embodiments, and various changes and modifications can be made within the spirit and scope of the present invention. Therefore, to appraise the public of the scope of the present invention, the following claims are made.

What is claimed is:

1. An ink-jet printer which prints an image by using printing means for discharging ink on a print medium, comprising:

heating means for heating the print medium;

reception means for receiving image information and designation information, separate from the image information, designating at least a portion of the image information and being independent of the size of the print medium;

storage means for storing control information for controlling feathering or bleeding of the image to be printed on the print medium, the control information corresponding to the designation information and being independent of the image information; and control means for controlling said heating means, in accordance with the control information, to heat an area of the print medium on which the image is to be printed based on the image information, wherein the area of the print medium to be heated is designated by the designation information.

2. The ink-jet printer according to claim 1, further comprising control-information generating means for generating the control information, in accordance with the designation information, based on the type of the image information of the image to be printed.

3. The ink-jet printer according to claim 2, wherein said control-information generating means generates the control information, in accordance with the designation information, to heat an area including a photographic image but not to heat other areas.

4. The ink-jet printer according to claim 3, wherein said printing means performs printing by using ink that quickly permeates into the print medium if the print medium has a high temperature but does not quickly permeate into the print medium if the print medium has a low temperature.

5. The ink-jet printer according to claim 2, wherein said control-information generating means generates the control information, in accordance with the designation information, not to heat an area including a photographic image but to heat other areas.

6. The ink-jet printer according to claim 5, wherein the ink quickly permeates into the print medium if the print medium has a low temperature but does not quickly permeate into the print medium if the print medium has a high temperature.

7. The ink-jet printer according to claim 2, wherein the designation information is generated based on an instruction from a user.

8. The ink-jet printer according to claim 2, wherein said control-information generating means generates the control information, in accordance with the designation information, based on a characteristic of the print medium.

9. The ink-jet printer according to claim 1, wherein said printing means forms an image in units of lines, and wherein said heating means has a plurality of heaters which independently heat a plurality of portions in one line.

10. The ink-jet printer according to claim 9, wherein said plurality of heaters heat the one line in pixel width units.

11. The ink-jet printer according to claim 1, wherein said heating means heats the print medium from a rear surface side of the print medium while printing is performed with respect to the print medium.

12. The ink-jet printer according to claim 1, wherein said heating means heats a print surface of the print medium prior to printing by said printing means.

13. The ink-jet printer according to claim 1, wherein said printing means has a plurality of color heads, which independently discharge a plurality of color inks, and forms a color image by scanning said color heads across the print medium.

14. The ink-jet printer according to claim 13, wherein said heating means comprises a plurality of heaters corresponding to the plurality of color heads.

15. The ink-jet printer according to claim 13, wherein said plurality of color heads are heads of respective colors arrayed in a scanning direction.

16. The ink-jet printer according to claim 13, wherein said plurality of color heads are heads of respective colors arrayed in a direction orthogonal to a scanning direction.

17. The ink-jet printer according to claim 1, wherein said printing means discharges ink droplets by applying thermal energy to the ink.

18. A printing method which prints an image by using printing means for discharging ink on a print medium, comprising the steps of:

heating the print medium using heating means;

receiving image information and designation information, separate from the image information, designating at least a portion of the image information and being independent of the size of the print medium;

storing control information for controlling feathering or bleeding of the image to be printed on the print medium, the control information corresponding to the designation information and being independent of the image information; and controlling (i) the heating means, in accordance with the control information, to heat an area of the print medium on which the image is to be printed based on the image information and (ii) printing of the image in accordance with the image information, wherein the area of the print medium to be heated is designated by the designation information.

19. The printing method according to claim 18, further comprising the step of generating the control information, in accordance with the designation information, based on the type of the image information of the image to be printed, prior to said controlling step.

20. The printing method according to claim 19, wherein in said generating step, the control information is generated, in accordance with the designation information, to heat an area including a photographic image but not to heat other areas.

21. The printing method according to claim 20, wherein the printing means is controlled in said controlling step to perform printing by using ink that quickly permeates into the print medium if the print medium has a high temperature but does not quickly permeate into the print medium if the print medium has a low temperature.

22. The printing method according to claim 19, wherein in said generating step, the control information is generated, in accordance with the designation information, not to heat an area including a photographic image but to heat other areas.

23. The printing method according to claim 22, wherein printing is performed in said printing controlling step by using ink that quickly permeates into the print medium if the print medium has a low temperature but does not quickly permeate into the print medium if the print medium has a high temperature.

24. The printing method according to claim 19, wherein the designation information is generated based on an instruction from a user.

25. The printing method according to claim 19, wherein in said generating step, the control information is generated, in accordance with the designation information, based on a characteristic of the print medium.

26. The printing method according to claim 18, wherein said printing controlling step prints the image in units of lines, and the heating means is controlled in said controlling step to heat a plurality of portions in one line independently.

27. The printing method according to claim 26, wherein the heating means is controlled in said controlling step to heat one line in pixel width units.

28. The printing method according to claim 18, wherein the printing means is controlled in said controlling step to print a color image by controlling a plurality of color heads which independently discharge a plurality of color inks.

29. The printing method according to claim 28, wherein the heating means comprises a plurality of heaters corresponding to the plurality of color heads.

30. The printing method according to claim 18, wherein the printing means is controlled in said controlling step to print the image by applying thermal energy to the ink so as to discharge ink droplets.

31. An ink-jet printer which prints an image by using an ink-jet head which discharges ink, comprising:

a heater provided opposite to a position of printing by said ink-jet head;

an external interface for receiving image information and designation information, separate from the image information, designating at least a portion of the image information and being independent of the size of the print medium;

a memory which stores control information for controlling feathering or bleeding of the image to be printed on a print medium, the control information corresponding to the designation information and being independent of the image information; and a heater controller which controls said heater in accordance with the control information, wherein an area of the print medium to be heated is designated by the designation information.

32. The ink-jet printer according to claim 31, further comprising a control-information generator for generating the control information, in accordance with the designation information, based on the type of the image information of the image to be printed.

33. The ink-jet printer according to claim 32, wherein said control-information generator generates the control information, in accordance with the designation information, to heat an area of the print medium including a photographic image but not to heat other areas.

34. The ink-jet printer according to claim 33, wherein the ink-jet head performs printing by discharging ink that quickly permeates into the print medium if the print medium has a high temperature but does not quickly permeate into the print medium if the print medium has a low temperature.

35. The ink-jet printer according to claim 32, wherein said control-information generator generates the control information, in accordance with the designation information, not to heat an area including a photographic image but to heat other areas.

36. The ink-jet printer according to claim 35, wherein the ink-jet head performs printing by discharging ink that quickly permeates into the print medium if the print medium has a low temperature but does not quickly permeate into the print medium if the print medium has a high temperature.

37. The ink-jet printer according to claim 32, wherein the designation information is generated based on an instruction from a user.

38. The ink-jet printer according to claim 32, wherein said control-information generator generates the control information based on a characteristic of the print medium.

39. The ink-jet printer according to claim 31, wherein said ink-jet head forms an image in units of lines, and wherein said heater independently heats a plurality of portions in one line.

40. The ink-jet printer according to claim 39, wherein said heater heats the one line in pixel width units.

41. The ink-jet printer according to claim 31, wherein said heater heats the print medium from a rear surface side.

42. The ink-jet printer according to claim 31, wherein said heater heats the print medium from the print surface side prior to printing by said ink-jet head.

43. The ink-jet printer according to claim 31, wherein said ink-jet head has a plurality of color heads which independently discharge a plurality of color inks, and wherein said heater has a plurality of heaters corresponding to the plurality of color heads.

44. The ink-jet printer according to claim 31, wherein said ink-jet head discharges ink droplets by applying thermal energy to the ink.

45. The ink-jet printer according to claim 1, wherein the control information is binary data for on/off control of said heating means.

46. The ink-jet printer according to claim 1, wherein the control information is multivalued data for multi-step controlling a temperature of heating by said heating means.

47. The ink-jet printer according to claim 1, wherein said control information is for controlling feathering of the ink on the print medium.

48. The ink-jet printer according to claim 1, wherein said control information is for controlling bleeding of the ink on the print medium.

49. The printing method according to claim 18, wherein the control information is binary data for on/off control of the heating means.

50. The printing method according to claim 18, wherein the control information is multivalued data for multi-step controlling a temperature of heating by the heating means.

51. The printing method according to claim 18, wherein said control information is for controlling feathering of the ink on the print medium.

52. The printing method according to claim 18, wherein said control information is for controlling bleeding of the ink on the print medium.

53. The ink-jet printer according to claim 31, wherein the control information is binary data for on/off control of said heater.

54. The ink-jet printer according to claim 31, wherein the control information is multivalued data for multi-step controlling a temperature of heating by said heater.

55. The ink-jet printer according to claim 31, wherein said control information is for controlling feathering of the ink on the print medium.

56. The ink-jet printer according to claim 31, wherein said control information is for controlling bleeding of the ink on the print medium.

57. An ink-jet printer which prints an image by using printing means for discharging ink on a print medium, comprising:

heating means for heating the print medium;

reception means for receiving image information and designation information, separate from the image information, designating at least a portion of the image information and being independent of the size of the print medium;

storage means for storing control information for controlling permeation of the image to be printed on the print medium, the control information corresponding to the designation information and being independent of the image information; and control means for controlling said heating means, in accordance with the control information, to heat an area of the print medium on which the image is to be printed based on the image information, wherein the area of the print medium to be heated is designated by the designation information.

58. A printing method for an ink-jet printer that prints an image by using printing means for discharging ink on a print medium, comprising the steps of:

heating the print medium using heating means;

receiving image information and designation information, separate from the image information, designating at least a portion of the image information and being independent of the size of the print medium;

storing control information for controlling permeation of the image to be printed on the print medium, the control information corresponding to the designation information and being independent of the image information; and controlling, in accordance with the control information, the heating means to heat an area of the print medium on which the image is printed based on the image information, wherein the area of the print medium to be heated is designated by the designation information.

59. An ink-jet printer which prints an image by using an ink-jet head which discharges ink, comprising:

a heater provided opposite to a position of printing by said ink-jet head;

an external interface for receiving image information and designation information, separate from the image information, designating at least a portion of the image information and being independent of the size of the print medium;

a memory which stores control information, for controlling permeation of the image to be printed on a print medium, the control information corresponding to the designation information and being independent of the image information; and a heater controller which controls said heater in accordance with the control information, wherein an area of the print medium to be heated is designated by the designation information.

60. An ink-jet printer which prints an image by using printing means for discharging ink on a print medium, comprising:

heating means for heating the print medium;

reception means for receiving image information and designation information;

storage means for storing control information for controlling feathering or bleeding of the image to be printed on the print medium, the control information corresponding to the designation information and being independent of the image information; and control means for controlling said heating means, in accordance with the control information, to heat an area of the print medium on which a photographic image is to be printed based on the image information, but not to heat other areas, wherein the area of the print medium to be heated is designated by the designation information.

* * * * *

UNITED STATES PATENT AND TRADEMARK OFFICE

CERTIFICATE OF CORRECTION

PATENT NO. : 6,511,147 B2 
DATED : January 28, 2003
INVENTOR(S) : Kubota et al.

It is certified that error appears in the above-identified patent and that said Letters Patent is hereby corrected as shown below:

Column 8,
Line 40, ":into" should read -- into --.
Line 60, "a" should read -- a --.

Column 9,
Line 42, "a" should read -- a --.

Signed and Sealed this

Eleventh Day of November, 2003

JAMES E. ROGAN
*Director of the United States Patent and Trademark Office*